US008756733B2

(12) United States Patent
Hughes et al.

(10) Patent No.: US 8,756,733 B2
(45) Date of Patent: Jun. 24, 2014

(54) PATIENT PAD FOR OPERATING THEATRE

(76) Inventors: Noel Robert Hughes, Wantirna South (AU); John Robert Copeland, Kensington (AU)

( * ) Notice: Subject to any disclaimer, the term of this patent is extended or adjusted under 35 U.S.C. 154(b) by 141 days.

(21) Appl. No.: 13/511,762

(22) PCT Filed: Nov. 26, 2010

(86) PCT No.: PCT/AU2010/001585

§ 371 (c)(1),
(2), (4) Date: Jun. 22, 2012

(87) PCT Pub. No.: WO2011/063460

PCT Pub. Date: Jun. 3, 2011

(65) Prior Publication Data

US 2012/0263856 A1 Oct. 18, 2012

(30) Foreign Application Priority Data

Nov. 26, 2009 (AU) ..... 2009905776

(51) Int. Cl.
*A61G 13/12* (2006.01)

(52) U.S. Cl.
USPC ..... 5/621; 5/612; 5/652; 5/655.5; 5/657; 5/655.9

(58) Field of Classification Search
USPC ..... 5/612, 621, 652, 655.9, 909; 128/845
See application file for complete search history.

(56) References Cited

U.S. PATENT DOCUMENTS

| | | | | |
|---|---|---|---|---|
| 4,583,725 | A * | 4/1986 | Arnold | 5/621 |
| 5,163,193 | A * | 11/1992 | Whitmore | 5/600 |
| 5,197,975 | A | 3/1993 | Mombrinie | |
| 5,248,182 | A | 9/1993 | Hittie | |
| 5,678,266 | A * | 10/1997 | Petringa et al. | 5/655.5 |
| 6,154,901 | A * | 12/2000 | Carr | 5/621 |
| 6,622,324 | B2 | 9/2003 | VanSteenburg et al. | |
| 8,234,730 | B2 * | 8/2012 | Skripps | 5/621 |
| 2010/0306894 | A1 * | 12/2010 | Calvert | 2/16 |

FOREIGN PATENT DOCUMENTS

| | | |
|---|---|---|
| GB | 838118 | 6/1960 |

* cited by examiner

*Primary Examiner* — Michael Trettel
(74) *Attorney, Agent, or Firm* — William E. Eshelman

(57) ABSTRACT

A disposable gel pad for cushioning the plate of an operating table's patient support apparatus is a block of gel with one face of the block adapted to locate the pad on the plate. Usually the pad will be enclosed in a film envelope. A pocket in the envelope allows the pad to engage the plate. Stick on patches which provide a pocket and sacroiliac pads axe variants. Sacroiliac pads can be cast with a soft gel front for patient contact joined to a hard gel rear for screw or bayonet fixing to the patient support apparatus.

10 Claims, 4 Drawing Sheets

PATIENT PAD FOR OPERATING THEATRE

FIELD OF THE INVENTION

This invention concerns disposable pads for patient positioning devices in operating theatres.

BACKGROUND OF THE INVENTION

In our co-pending application for Patent No. PCT/AU2005/000732, we describe a set of clamps for fixing to the side rail of an operating table. The clamps lock in different angular positions and have at one end a plate which is adjusted to lie next to the torso of the patient on the operating table. When the clamps are paired and both left and right hand side of the patients body are confined by plates, the theatre staff can arrange the patient in a suitable position for the operation in hand knowing firstly that the patient will not fall from the table even when there is rapid repositioning as a result of cardiac arrest, and secondly that the surgeon has good access to the operating site.

The prior art devices for contacting the patient are steel or aluminium plates either circular and rectangular about the size of a human hand but mote usually they are a vinyl covered, upholstered pad fixed to a metal plate which is in turn mounted on an arm for bringing it close to the patients body. While metal apparatus is easy to sterilise, the pads described above and clothing and drapes are more difficult. The vinyl surface of the pad is gathered, tucked or pleated to be a close fit on the convex curves of the pad. Laundering deals with reusable items while masks, gloves and dressings are disposable, but surface application of antiseptic to the vinyl pads may be effective, but sometimes it is not.

The previously known pads are an integral part of the patient support system and present a sterilisation problem for the theatre staff.

SUMMARY OF THE INVENTION

One apparatus aspect of the invention provides a disposable gel pad for cushioning the plate of an operating tables patient support apparatus, comprising a block of gel with means on one face to locate the pad on the plate. The means may be a pocket, cavity in the block itself. The block may be contained in an impervious film envelope. When the block has such an envelope, the envelope may have an extra wall of film over one face so the space between can act as a pocket for the plate.

Alternatively the pocket may be a stick on patch with an aperture for admission of the plate or part thereof. The patch may be made of plastic film with pressure activated adhesive on one face and given a partially adhesive area by folding.

Preferably the block is sufficiently large to protect the sacroiliac crest. The envelope may be made of PVC, neoprene and equivalents already In the literature.

When the pad has a pocket for admission of a plate the pocket may have an aperture for passage of the pad mount. This is because the mount may be in the central area of the pad which can be circular, rectangular, etc. Consequently sliding the pocket of the gel pad on to the metal plate can only be partial until the mount impedes further entry.

In Patent Application No. PCT/AU2005/000732 there is such a fitting. A clamping nut screws on to a threaded spigot and the spigot projects from an 100 mm×160 mm plate. The pads will commonly be circular or rectangular in profile but may be kidney shaped, capstan shaped or elliptical.

The gel block itself may be 15-40 mm thick having the consistency of female breast tissue. This is useful for exerting a comfortable restraining pressure on a patient's torso. The gel may be made of water and polyurethane foam. Alternatively cellulose derivatives may be used as a thickening agent for an aqueous base. Suitable gel mixes are described in U.S. Pat. No. 5,531,786. If the pads end up in landfill and the envelope is pierced, the gels undergo biodegradation.

Some users may prefer to balance single use only by utilising the soft gel content for patient consumption. Accordingly, the soft gel may be sterile edible gels like custard already manufactured with a long shelf life.

BRIEF DESCRIPTION OF THE DRAWINGS

One embodiment of the invention is now described with reference to the accompanying drawings, in which.

DETAILED DESCRIPTION WITH RESPECT TO THE DRAWINGS

Figure 1:
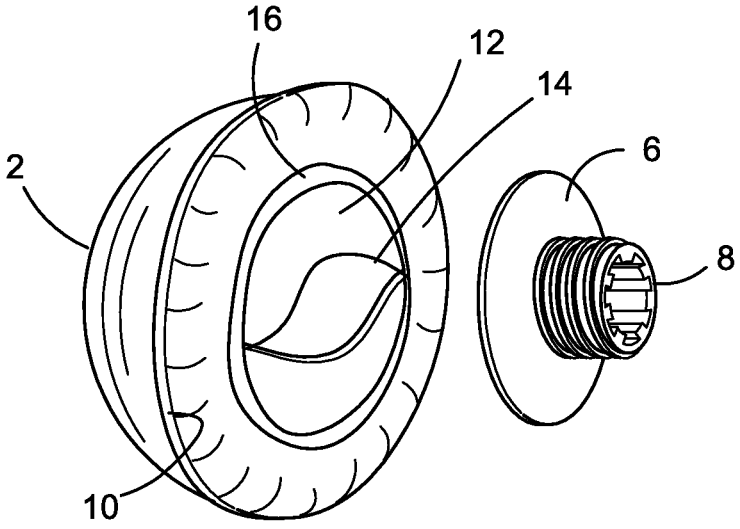
FIG. 1 is a side view of a pad alongside a vertical patient support plate.

In FIG. 1, the circular envelope 2 is made of a pair of sheet plastic discs heat sealed around a gel disc 4 using an RF press. The envelope is 86 mm in diameter and 18 mm thick. The discs are polyurethane. The circular support plate 6 is a disc of stainless steel from which threaded splined spigot 8 extends.

Figure 2:
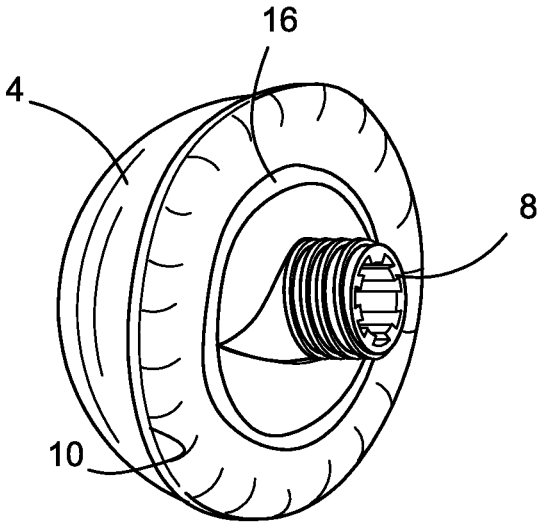
FIG. 2 is a side view of the pad of FIG. 1 in position on the support plate.

In FIG. 2, the annular sealing flange 10 is visible and a circular pocket 12 extending 300° around the face of the envelope in an annular fashion broken by pocket entrance 14 which is substantially diamond shaped. The pocket is sealed to one face of the envelope around its outer edge 16. The pad is offered up to the plate and the PVC envelope is stretched to allow the plate through the entrance 14.

The pad then retains its position and cushions the patient when the patient's body presses against the plate.

Figure 3A:
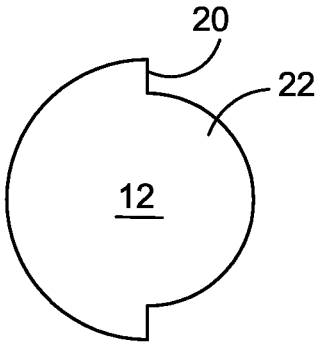
FIGS. 3*a*-3*c* are an assembly sequence for a variant pad.
Figure 3B:
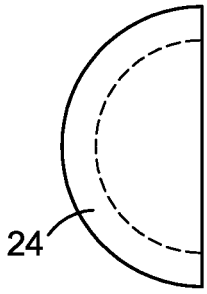
Figure 3C:
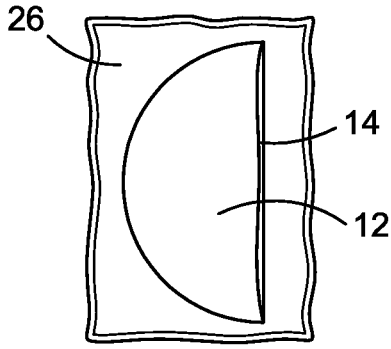
Figure 4:
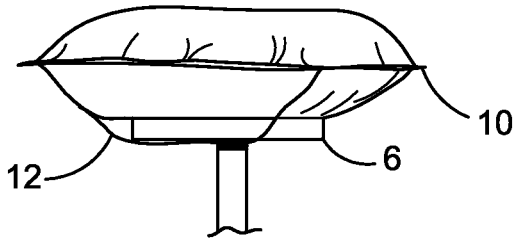
FIG. 4 is a side view of the pad of FIG. 3 slid on to a circular plate.

In the variant of FIG. 3, a pocket 12 is cut from plastic sheet rendered adhesive on one face. The perimeter has a step 20 giving two diameters. When the pocket is folded across the step, portion 22 overlies part of the pocket leaving an arcuate border 24. When this is applied to rectangular envelope 26, a pocket is formed capable of admitting half of circular plate 6. The engagement of pocket and plate is seen in FIG. 4.

Figure 5:
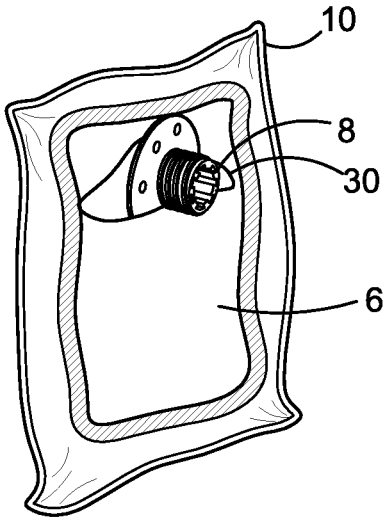
FIG. 5 is a perspective view of a pad in position on a plate with a threaded spigot projecting from one face thereof.

If the plate 6 is rectangular with a mount 8 as in FIG. 5, the pocket 12 is rectangular end a triangular aperture 30 is excised from the pocket to allow the mount to protrude. The mount is screwed to the arm of a patient support linkage fixed to the operating table.

Figure 6:
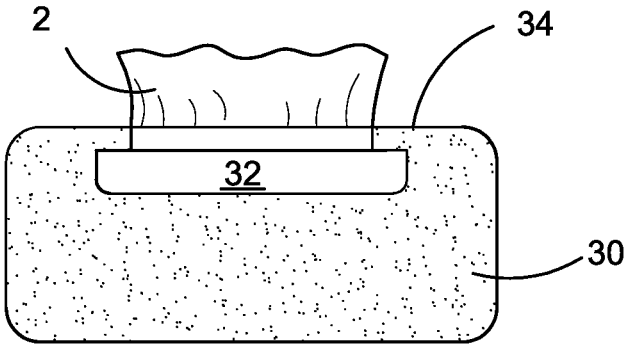
FIG. 6 is a side section of a pad with the film envelope ready to be trimmed.

In FIG. 6, the block 30 is cast with a cavity 32 in one face using a collapsing core. The annular rim 34 is readily deformable by stretching up to 250% of the cast diameter. The mould is lined with PVC film prior to casting and the film is trimmed from the rim 34 after casting. This provides the block with an envelope just like the embodiments of FIGS. 1-5.

When surgeons conduct hip surgery the patient is supported on the operating table on his/her side with a clamp urging a pair of ventral pads contacting the sacroiliac crests while a dorsal pad contacts the patients back. In this position one hip is suitably accessible to the surgeon, however the upper pad must of necessity lie close to the site of the incision and the operational site. Although the area is draped the possibility of brushing the pad and the operational site is ever present. Consequently aseptic procedure must be reliable and the pads must cover the mounts which hold them in place and be sterile.

Figure 7:
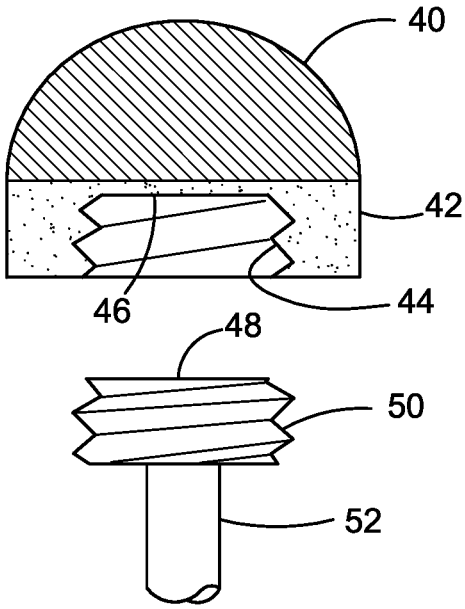
FIG. 7 is a side section of a pad suitable for contact with the sacroiliac crest.

The highest reliability occurs if the pads are sterile when unpacked and applied to the mounts and then discarded at the end of each operation so that fresh patients are supported with fresh pads. It is customary to use pads similar to those shown in FIG. 6 except that the pad is planoconvex instead of cylindrical. In FIG. 7 the pad is made of a planoconvex head 40, 98 mm in diameter and 28 mm thick, is attached to a disc shaped tail 42 with a threaded cavity 44 about 10 mm deep with a diameter of 57 mm. The thread is coarse so that a ¾ turn causes the end 46 of the cavity to abut the end face 48 of threaded steel mount 50.

Mount 50 is fixed to the end of 16 mm dia. stem 52 of a sacroiliac clamp (not shown). When the operation ends, the drapes are removed, the pads are unscrewed and collected with the flat pads for disposal. The metal parts are sterilised by the application of liquid antiseptic. Employing this procedure reduces cross-infections in the operating theatre.

The pads in FIG. 7 are manufactured by a two stage casting process. Initially the planoconvex head is cast by sending polyurethane into a concave mould, whereafter a mould cap with a threaded spigot is located above the cast head and hard polyurethane mix is sent through sprues in the cap to lie on top of the cast head so that the hard and soft gels mutually adhere. When the cap is unscrewed, the casting is released from the mould.

Figure 8:
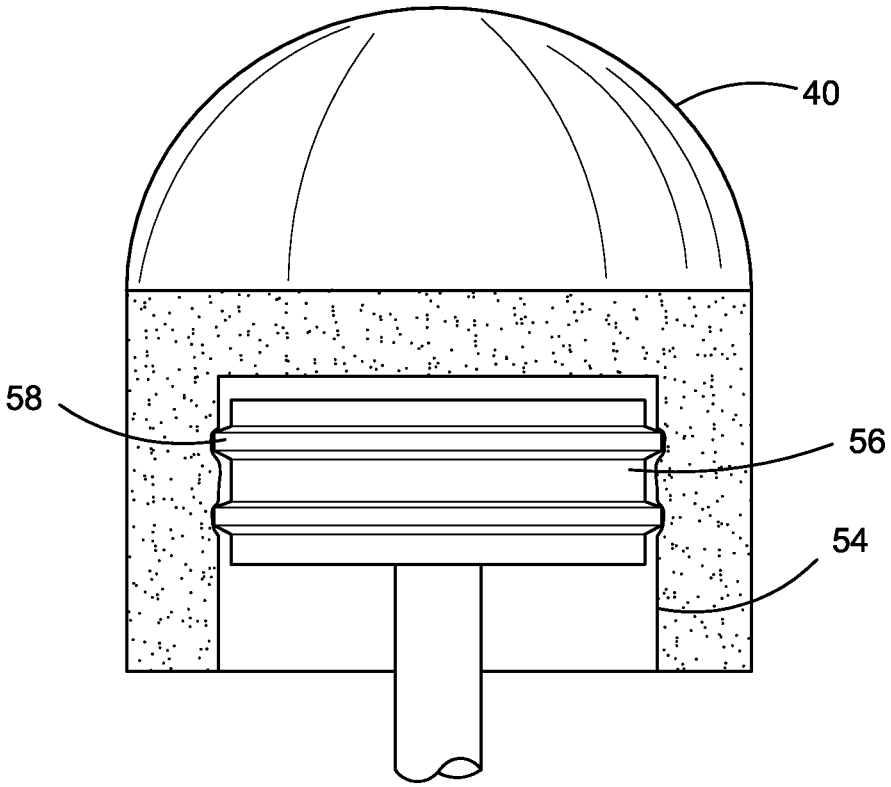
FIG. 8 is a side section of a push fit pad variant.

In FIG. 8, the pad is made of soft and hard gels as described above but die cylindrical cavity 54 in the hard gel tail is a push fit onto the mount 56. The head of the mount has circumferential ridges 58 to arrest the tail once it is impaled. A partial vacuum is created which assists in pad retention.

Figure 9:
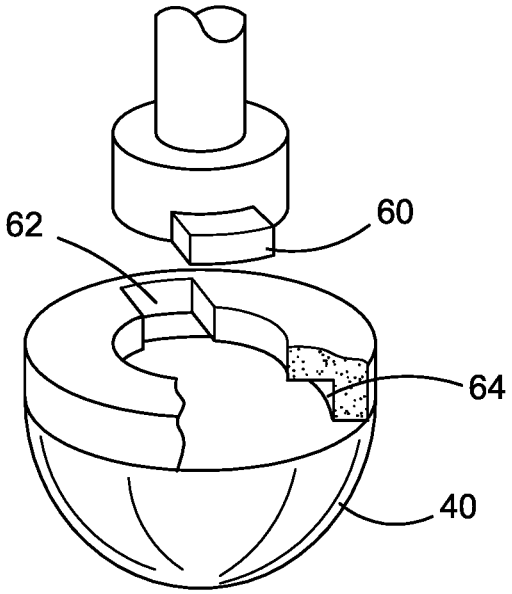
FIG. 9 is a sectional perspective of a bayonet fit variant.

In FIG. 9, the mount has a spline 60 which fits axially into a cutout 62 in the tail. This permits the spline 60 to rotate into cavity 64 in the tail of the pad and to be retained until the reverse rotation releases it from the mount. Again the moulds of FIGS. 7, 8 and 9 are lined with PVC film as with FIG. 6 so that the blocks emerge from casting with an envelope which is trimmed after casting.

We have found the advantages of the above embodiment to be:

1. The pads are easily applied and removed from the metal supports.
2. The pads are sterilisable.
3. The pads are disposable and therefore each operation utilises fresh pads.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. It is feasible to omit the envelope in some of the above embodiments, for example when the pad is not for use in the vicinity of the sterile area around the incision or in other circumstances where the risk is reduced. These modifications and/or additions are therefore considered to fall within the scope of the invention.

The claims defining the invention are as follows:

1. A gel pad for cushioning the plate or mount of an operating table's patient support apparatus, comprising a block of gel contained within an impervious sheet envelope wherein the envelope has an extra sheet wall over one face so space between the wall and the envelope acts as a pocket for the plate or mount.

2. A gel pad as claimed in claim 1, wherein the pocket is a stick-on patch with an aperture for admission of the plate or part thereof.

3. A gel pad as claimed in claim 2, wherein the patch is made of sheet plastic with contact adhesive on one face and a partially non-adhesive area erected by folding.

4. A gel pad as claimed in claim 1, wherein the block is circular with a flat face and a convex face for contacting a sacroiliac crest.

5. A gel pad as claimed in claim 4, wherein the flat face is secured to a threaded tubular part for coupling to a mount on a wall of an adjustable arm forming part of the patient support apparatus.

6. A gel pad as claimed in claim 1, wherein a pad profile is modified from one of rectangular and circular to suit the support job which the pad must perform.

7. A gel pad as claimed in claim 1, wherein at least a portion of the block of gel comprises a soft gel that is edible and is a patient nourishing food.

8. A gel pad for cushioning the plate or mount of an operating table's patient support apparatus, comprising a block of gel with means on one face to locate the pad on the plate or mount, wherein the means is a block of hard gel with a threaded cavity for reception of a threaded mount.

9. A gel pad as claimed in claim 8, wherein a patient contacting portion of the pad is made of soft gel and a mount contacting portion is made of hard gel.

10. A gel pad for cushioning the plate or mount of an operating table's patient support apparatus, comprising a block of gel with means on one face to locate the pad on the plate or mount, wherein the means is a block of hard gel with an undercut cavity and a cutout to admit a spline of the pad mount in order to allow a bayonet type engagement.

* * * * *